US006700360B2

(12) United States Patent
Biagi et al.

(10) Patent No.: US 6,700,360 B2
(45) Date of Patent: Mar. 2, 2004

(54) OUTPUT STAGE COMPENSATION CIRCUIT

(75) Inventors: Hubert J. Biagi, Tucson, AZ (US); Rodney T. Burt, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 4 days.

(21) Appl. No.: 10/107,270

(22) Filed: Mar. 25, 2002

(65) Prior Publication Data

US 2003/0178978 A1 Sep. 25, 2003

(51) Int. Cl.[7] ..... G05F 1/40

(52) U.S. Cl. ..... 323/280; 323/281; 323/275; 327/553; 327/555

(58) Field of Search ..... 323/280, 281, 323/274, 275, 277; 327/465, 553, 554, 555

(56) References Cited

U.S. PATENT DOCUMENTS 5,191,278 A * 3/1993 Carpenter ..... 323/275
5,559,424 A * 9/1996 Wrathall et al. ..... 323/277
5,861,736 A * 1/1999 Corsi et al. ..... 323/273
6,246,221 B1 * 6/2001 Xi ..... 323/280
6,465,994 B1 * 10/2002 Xi ..... 323/274
6,483,727 B2 * 11/2002 Oki et al. ..... 363/39
6,518,737 B1 * 2/2003 Stanescu et al. ..... 323/280
6,522,112 B1 * 2/2003 Schmoock et al. ..... 323/280

* cited by examiner

*Primary Examiner*—Shawn Riley
(74) *Attorney, Agent, or Firm*—W. Daniel Swayze, Jr.; W. James Brady; Frederick J. Telecky, Jr.

(57) ABSTRACT

An output stage compensation circuit and method for a low drop-out regulator configured to facilitate stable operation while providing output voltage and current to downstream circuit devices is provided. An exemplary low drop-out regulator is configured with an output stage compensation circuit including one or more segmented sense devices configured to drive one or more fixed current sources. Each segmented sense device is configured to compensate a suitable range of output current and to multiply the effect of associated compensation capacitors. The one or more segmented sense devices are configured to provide pole-zero compensation based on output current. Further, the current range of each segment can be overlapped. As a result, the stability of the low drop-out regulator is not dependent upon the output current requirements or the capacitance requirements of the downstream circuit.

28 Claims, 3 Drawing Sheets

LOW DROP OUT
REGULATOR
400

$V_{IN}$
ERROR
AMPLIFIER
402
CURRENT
FEEDBACK
BUFFER
404
$V_{BG}$
410
2x
412
1x
406
$M_P$
$C_1$
$C_2$
$V_{OUT}$
$C_C$
414
416
$R_1$
$R_C$
$V_{FDBK}$
403
$R_2$
408

OUTPUT STAGE COMPENSATION CIRCUIT

FIELD OF INVENTION

The present invention relates to power supply circuits. More particularly, the present invention relates to a output stage compensation method and circuit, such as may be used with low drop-out regulators or other output stage circuits.

BACKGROUND OF THE INVENTION

The increasing demand for higher performance power supply circuits has resulted in the continued development of voltage regulator devices. Many low voltage applications are now requiring the use of low dropout (LDO) regulators, such as for use in cellular phones, pagers, laptops, camera recorders and other mobile battery operated devices as power supply circuits. These portable electronics applications typically require low voltage and quiescent current flow to facilitate increased battery efficiency and longevity. The alternative to low drop-out regulators are switching regulators which operate as dc—dc converters. Switching regulators, though similar in function, are not preferred to low dropout regulators in many applications because switching regulators are inherently more complex and costly, i.e., switching regulators can have higher cost, as well as increased complexity and output noise than low drop-out regulators.

Low drop-out regulators generally provide a well-specified and stable dc voltage whose input to output voltage difference is low. Low drop-out regulators are generally configured for providing the power requirements, i.e., the voltage and current supply, for any downstream portion of the electrical circuit. Low drop-out regulators typically have an error amplifier in series with a pass device, e.g., a power transistor, which is connected in series between the input and the output terminals of the low drop-out regulator. The error amplifier is configured to drive the pass device, which can then drive an output load.

To provide for a more robust low drop-out regulator, a large load capacitor is provided at the output of the low drop-out regulator. However, using large capacitors at the output of the low drop-out regulator requires a significant amount of board area, as well as increases manufacturing costs. Further, larger capacitors can tend to slow the response time down of the low drop-out regulator.

For example, with reference to FIG. 1, a prior art circuit 100 implementing a low drop-out regulator is illustrated. Circuit 100 includes a low drop-out regulator 102 coupled to a downstream circuit device, e.g., a digital signal processor (DSP) 104. At the input of low drop-out regulator 102 is a supply voltage $V_{IN}$, such as a low voltage battery supply of 3.3 volts or less, and an input capacitor $C_1$. At an output $V_{OUT}$ of low drop-out regulator 102, a regulated output of, for example, 2.5 volts can be provided to the downstream circuit elements and devices. In addition, a large load capacitor $C_2$ is provided at output $V_{OUT}$ Of low drop-out regulator 102. In addition to enabling low drop-out regulator 102 to be more robust, load capacitor $C_2$ can provide compensation to low drop-out regulator 102 to enable low drop-out regulator 102 to work properly. This compensation of low drop-out regulator 102 can be highly sensitive to the configuration of capacitor $C_2$.

Downstream elements and devices are coupled to output $V_{OUT}$ of low drop-out regulator 102 through various circuit traces and wiring connections. Capacitor $C_2$ also serves as an input capacitor to DSP 104. As the input capacitor, designers of applications for DSP 104 typically require capacitor $C_2$ to comprise between 10 $\mu$F and 100 $\mu$F of capacitance to facilitate noise reduction in DSP 104. Thus, in most applications, capacitor $C_2$ is based on the bypass requirement of the downstream circuit and components, such as DSP 104, rather than the compensation requirements of low drop-out regulator 102. As a result, the design of low drop-out regulator 102, including the compensation requirements, is generally limited by the bypass requirements of the downstream circuit devices and elements.

Input capacitance devices, such as capacitor of DSP 104, also include an equivalent series resistance (ESR) that must be accounted for in the design of low drop-out regulator 102. Further, for downstream circuits with high transient requirements, the total capacitance is ideally configured to tailor the overshoot and undershoot of low drop-out regulator 102. In many instances, the design of a compensation circuit for low drop-out regulator 102 can involve substantial guesswork as to the range of total capacitance, and the ESR of such capacitance, expected to be included within the downstream circuit. Thus, prior art low drop-out regulators, and their required compensation, are generally configured for a particular range of ESR and total capacitance for downstream circuit devices. As a result, circuit designers must pick and choose a particular low drop-out regulator configured for a given ESR and total capacitance of a downstream circuit application.

In addition to the need to identify the capacitance requirements of the downstream circuit in designing the compensation circuit for low drop-out regulator 102, it is also necessary to address poles created within a low drop-out regulator. Whenever a pole is introduced in the frequency response, the gain of low drop-out regulator decreases by more than 20 dB/decade. Poles can be generated or caused by various sources, and occur at various locations within the frequency response of a low drop-out regulator or other output stage circuit. For example, one pole comprising a dominant pole often occurs at a very low frequency, such as 10 Hz; another pole can often occur from an internal loop; and yet another pole can be caused by various parasitics and the $g_m$ in the low drop-out regulator, e.g., the additional pole can be caused in some topologies by the interaction of the low $g_m$ of the error amplifier with the gate capacitance of the typically large common source pass device. With reference to FIG. 2, three such poles are illustrated. However, the frequency responses of low drop-out regulators can include fewer or additional poles to the three types discussed above.

While many poles can be partly addressed through use of bandwidth limitations, the poles caused by various parasitics and the amount of current utilized in driving the pass device of the low drop-out regulator 102 are difficult to compensate. While one configuration may work well for low current operation, the same configuration does not work well for high current operation.

Accordingly, a need exists for an output stage compensation method and circuit for low drop-out regulators that can overcome the various problems of the prior art.

SUMMARY OF THE INVENTION

The method and circuit according to the present invention addresses many of the shortcomings of the prior art. In accordance with various aspects of the present invention, an output stage compensation circuit and method for a low drop-out regulator configured to facilitate stable operation while providing output voltage and current to downstream circuit devices is provided.

In accordance with an exemplary embodiment, an exemplary low drop-out regulator is configured with an output stage compensation circuit comprising one or more segmented sense devices configured to drive one or more current sources. Each segmented sense device is configured to compensate a suitable range of output current. In addition, one or more segmented sense devices can be configured to multiply the effect of compensation capacitors coupled to one or more segmented sense devices. During operation, one or more segmented sense devices can be configured to provide pole-zero compensation by introducing a zero in the open-loop gain of the low drop-out regulator at the appropriate frequency and level of output current. As a result, the stability of the low drop-out regulator is not dependent upon the output current requirements or the capacitance of the load capacitor. Further, the load capacitor can be suitably configured to address the transient response of the downstream circuit devices.

In accordance with another exemplary embodiment, the various ranges of output current can be overlapped when being compensated by a plurality of segmented sense devices. Further, the plurality of segmented sense devices can be suitably scaled at different levels depending on a desired compensation effect.

In accordance with another aspect of the present invention, the output stage compensation scheme significantly reduces die area required for compensation. For example, through the transient nature of operation of segmented current sense devices 530, 532, 534, 536 and 538, a multiplication of the effects of compensation capacitors $C_1$, $C_2$, $C_3$, $C_4$ and $C_5$ occurs during compensation.

In accordance with another aspect of the present invention, the output stage compensation scheme results in very low quiescent current, along with a very high effective beta, i.e., the ratio of the output current to the quiescent current is high.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS OF THE INVENTION

Figure 1:
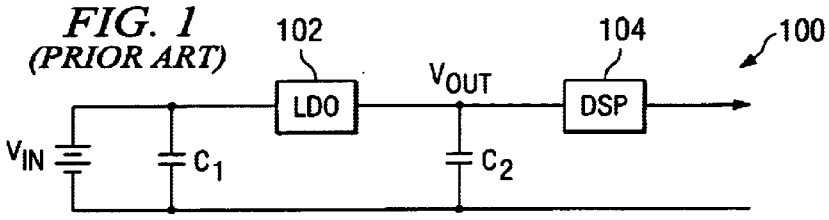
FIG. 1 (PRIOR ART)
FIG. 1 illustrates a schematic diagram of a prior art power supply circuit including a low drop-out regulator configured with a downstream device.
Figure 2:
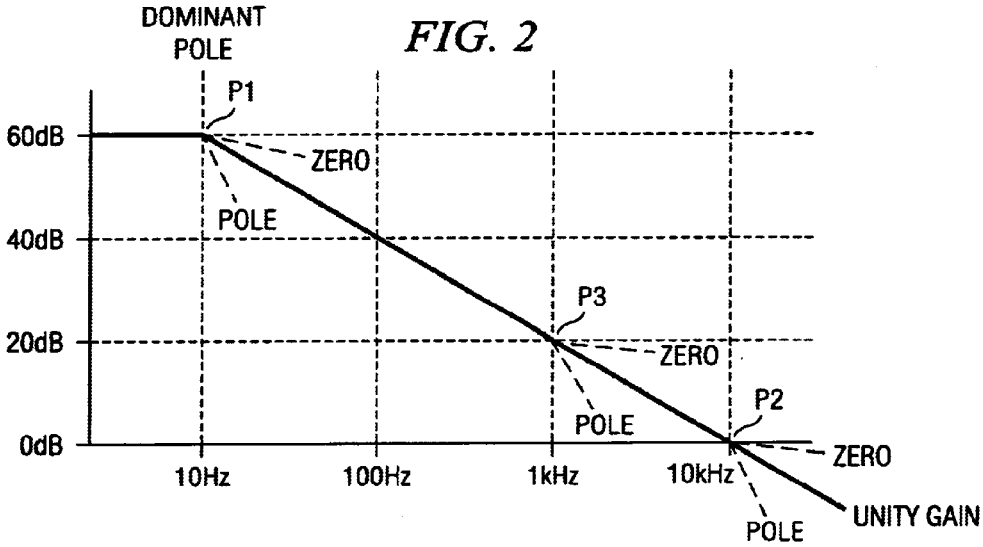
FIG. 2 illustrates a schematic diagram of an exemplary frequency response for a low drop-out regulator.

The present invention may be described herein in terms of various functional components and various processing steps. It should be appreciated that such functional components may be realized by any number of hardware or structural components configured to perform the specified functions. For example, the present invention may employ various integrated components, such as buffers, current mirrors, and logic devices comprised of various electrical devices, e.g., resistors, transistors, capacitors, diodes and the like, whose values may be suitably configured for various intended purposes. In addition, the present invention may be practiced in any integrated circuit application, e.g., any output stage configuration. For purposes of illustration only, exemplary embodiments of the present invention will be described herein in connection with low drop-out regulators. Further, it should be noted that while various components may be suitably coupled or connected to other components within exemplary circuits, such connections and couplings can be realized by direct connection between components, or by connection through other components and devices located thereinbetween.

As discussed above, the compensation of prior art low drop-out regulators is heavily dependent upon the output current requirements and the load capacitance of downstream circuit devices. However, in accordance with various aspects of the present invention, an exemplary output stage compensation circuit and method for a low drop-out regulator is configured to facilitate stable operation while providing output voltage and current to downstream circuit devices.

In accordance with an exemplary embodiment, an exemplary low drop-out regulator is configured with an output stage compensation circuit comprising one or more segmented sense devices configured to drive one or more current sources. Each segmented sense device is configured to compensate a suitable range of output current. In addition, one or more segmented sense devices can be configured to multiply the effect of compensation capacitors coupled to one or more segmented sense devices. During operation, one or more segmented sense devices can be configured to provide pole-zero compensation by introducing a zero in the open-loop gain of the low drop-out regulator at the appropriate frequency and level of output current. This introduction of a zero counteracts the pole created by the $g_m$ of the error amplifier interacting with the capacitance seen at the input to the output stage compensation circuit in combination with the gate capacitance of the pass device. As a result, the stability of the low drop-out regulator is not dependent upon the output current requirements or the capacitance of the load capacitor. Further, the load capacitor can be suitably configured to address the transient response of the downstream circuit devices, rather than having the load capacitor dependent upon the operation and design of the low drop-out regulator.

Figure 3:
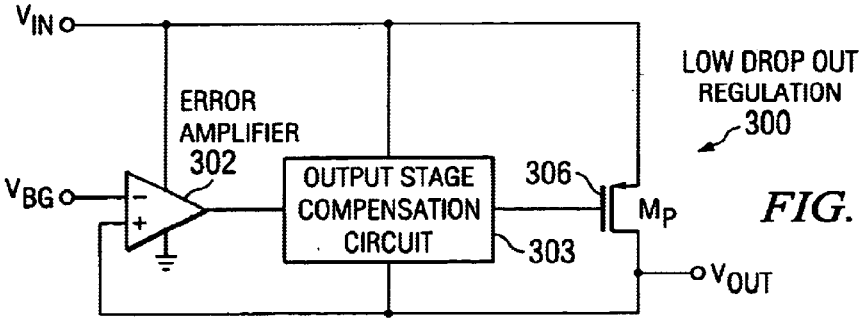
FIG. 3 illustrates a block diagram of an exemplary low drop-out regulator with output stage compensation in accordance with an exemplary embodiment of the present invention.

With reference to FIG. 3, an exemplary low drop-out regulator 300 with output stage compensation is illustrated. Low drop-out regulator 300 suitably comprises an error amplifier 302, output stage compensation circuit 303, and a pass device 306. Error amplifier 302 is configured to drive a low current during DC conditions, and a high current, e.g., 1 mA, under high slew or transient conditions. In accordance with an exemplary embodiment, error amplifier 302 suitably comprises a class A type amplifier device. Error amplifier 302 can comprise various configurations, such as a single error amplifier, or an error amplifier having a buffer, or a $g_m$ boost, configured for buffering the output of error amplifier 302, and/or isolating a high output resistance of a gain stage of error amplifier 302.

Error amplifier 302 has a negative input connected to a reference voltage, such as a bandgap voltage $V_{BG}$, configured to provide a stable dc bias voltage with limited current driving capabilities, and can be powered by an input supply voltage $V_{IN}$. Error amplifier 302 can also include a feedback signal from an output terminal $V_{OUT}$ coupled to a positive input terminal of error amplifier 302.

Pass device 306 comprises a power transistor device configured for driving an output current $I_{OUT}$ to a load device. Pass device 306 has a control terminal, e.g., a gate terminal, suitably coupled to the output of error amplifier 302 to control operation of pass device 306. In the exemplary embodiment, pass device 306 comprises a PMOS transistor device having a source coupled to a supply voltage rail $V_{IN}$, and a drain coupled to a output voltage terminal $V_{OUT}$. However, pass device can comprise any power transistor configuration, such as NPN or NMOS follower transistors, a common emitter PNP transistor, or any other transistor configuration for driving output current $I_{OUT}$ to a load device. Thus, for example, pass device 306 can comprise a bipolar transistor including a control terminal that comprises a base terminal. Pass device 306 is configured to source as much current as needed by the load device.

Output stage compensation circuit 303 can be configured to provide pole-zero compensation by introducing a zero in the open-loop gain of low drop-out regulator 300 at the appropriate frequency and level of output current from error amplifier 302. Output stage compensation circuit 303 is configured to receive the output signal of error amplifier 302, i.e., the output current for driving the gate of pass device 306, and to compensate the output signal for driving pass device 306. This introduction of a zero counteracts the pole created by the $g_m$ of error amplifier 302 interacting with the capacitance seen at the input to output stage compensation circuit 303 in combination with the gate capacitance of pass device 306.

In accordance with an exemplary embodiment, output stage compensation circuit 303 comprises one or more segmented sense devices. Each segmented sense device of output stage compensation circuit 303 is configured to compensate for a range of output current. An exemplary segmented sense device suitably comprises a sense transistor having a source coupled to upper supply rail voltage $V_{IN}$, a gate coupled to the output of error amplifier 302, and a drain coupled to a current source. In addition, the segmented sense device includes a capacitor coupled to its gate and drain terminals.

Figure 4:
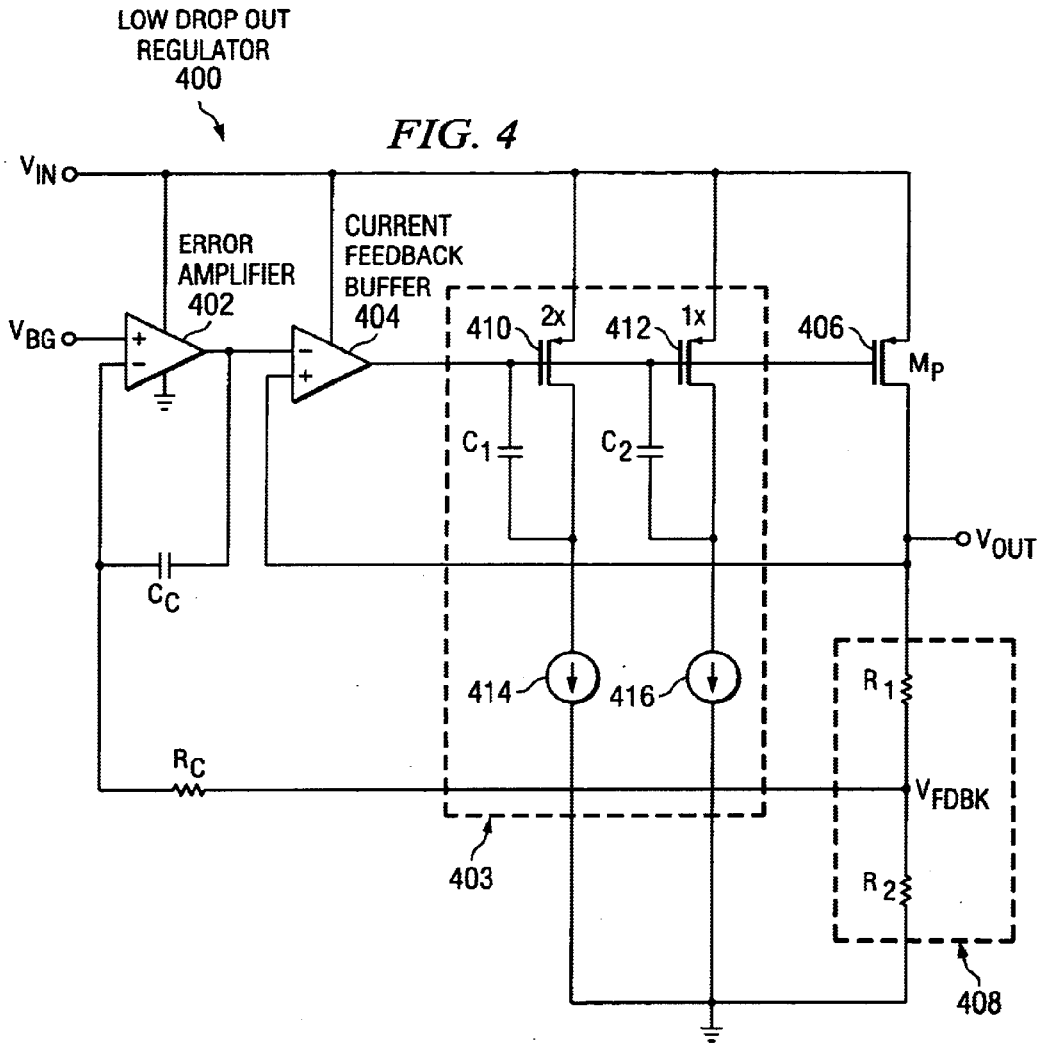
FIG. 4 illustrates a block and schematic diagram of an exemplary embodiment of a low drop-out regulator having a current feedback buffer with output stage compensation in accordance with the present invention.

Output stage compensation circuit 303 can be suitably configured in various arrangements for providing compensation to a low drop-out regulator, or any output stage configuration. For example, output stage compensation circuit 303 can be suitably configured at the output of any amplifier or buffer device. With reference to a low drop-out regulator 400 illustrated in FIG. 4, an output stage compensation circuit 403 can be suitably configured at the output of a current feedback amplifier 404 and coupled to the gate of a pass device 406 within low drop-out regulator 400. In this exemplary embodiment, low drop-out regulator 400 includes a composite amplifier feedback configuration for an error amplifier 402, such as disclosed more fully in U.S. patent application Ser. No. 10/151,366, entitled "Low Drop-Out Regulator Having Composite Amplifier With Current Feedback Buffer", filed on May 20, 2002, and having a common inventor and common assignee as the present application, and hereby incorporated herein by reference. Low drop-out regulator 400 is configured with error amplifier 402 receiving a composite feedback signal from a node $V_{FBK}$ in a divider network 408. In addition, current feedback amplifier 404 includes a local feedback loop decoupled from the overall feedback configuration. As a result, current feedback buffer 404 can be configured to operate with low current supplied from error amplifier 402 and to drive the control terminal, i.e., the gate, of pass device 406 with sufficiently high current as demanded by a load device.

In accordance with this exemplary embodiment, output stage compensation circuit 403 comprises a plurality of segmented sense devices, for example two segmented sense devices 410 and 412, configured to drive a plurality of fixed current sources, such as two current sources 414 and 416. Each segmented sense device 410 and 412 is configured to compensate a suitable range of output current. While other exemplary embodiments may include only a single segmented current sense device, such a sense device may only cover a particular range of compensation for the output current provided to pass device 406, and thus utilizing a plurality of segmented sense devices facilitates overlapping of the range of compensation that can be provided.

An exemplary segmented sense device, such as segmented devices 410 and 412, suitably comprises a sense transistor having a source coupled to upper supply rail voltage $V_{IN}$, a gate coupled to the output of current feedback amplifier 404, and a drain coupled to a current source, such as current sources 414 and 416. In addition, segmented sense devices 410 and 412 include a compensation capacitor, such as capacitors $C_1$ and $C_2$, coupled to their respective gate and drain terminals. Segmented sense devices 410 and 412 are configured to multiply the effect of compensation capacitors $C_1$ and $C_2$. Further, segmented sense devices 410 and 412 are configured as scale devices to suitably cover a range of current, such as a 2X device and a 1X device, with the larger sense device, i.e., sense device 410 comprising a 2X device, being configured to sense lower current ranges than the smaller sense device, i.e., sense device 412 comprising a 1X device. Moreover, the scaling of sense devices 410 and 412 can be over various ranges, such as octave, decade or other scaling ranges.

Figure 5:
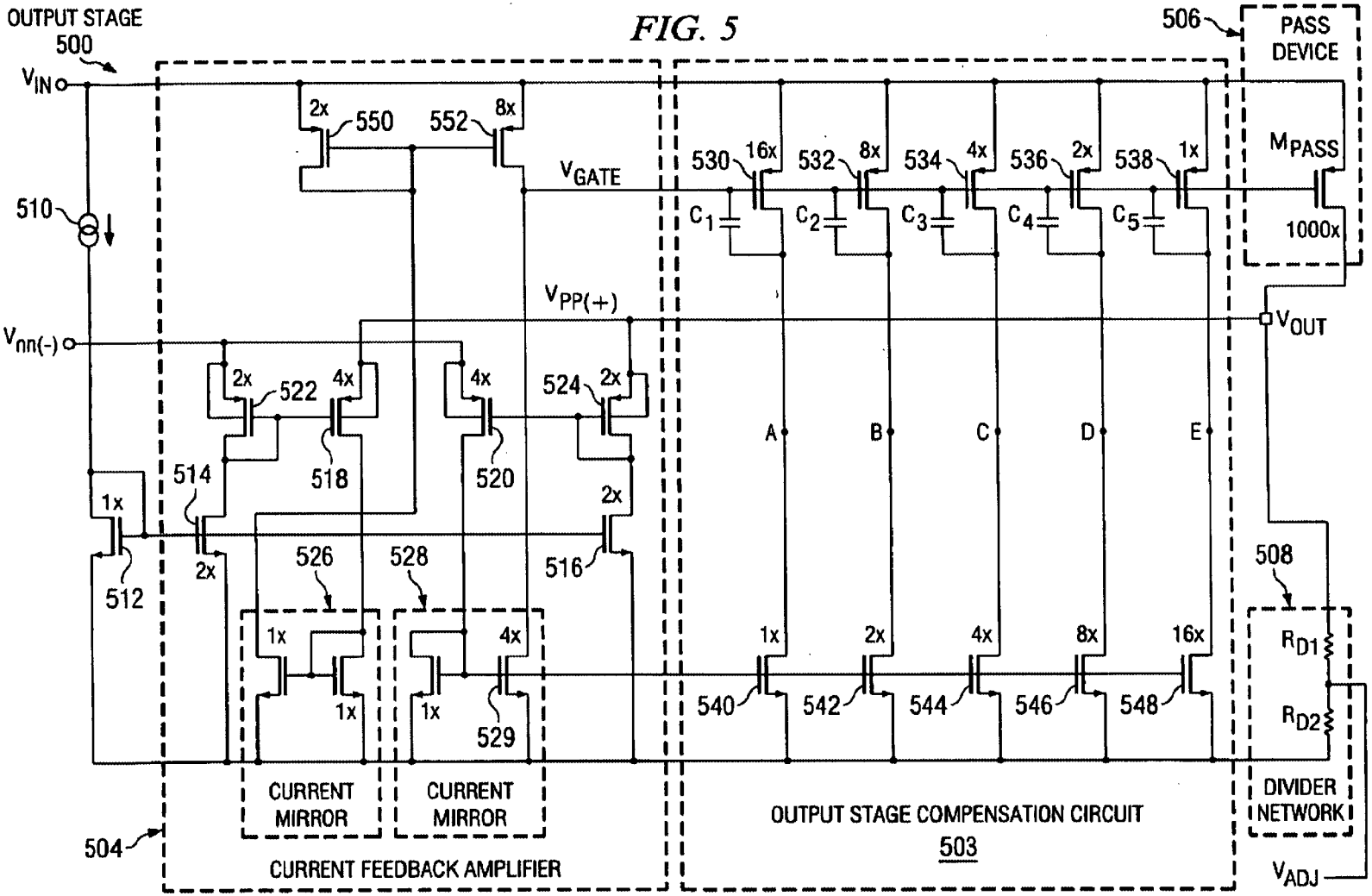
FIG. 5 illustrates a schematic diagram of an exemplary output stage compensation circuit configured with a current feedback buffer in accordance with an exemplary embodiment of the present invention.

Having described an exemplary output stage compensation scheme for a low drop-out regulator, a more detailed illustration in accordance with an exemplary embodiment can be provided. With reference to FIG. 5, an exemplary output stage 500 of a low drop-out regulator can be provided with an output stage compensation circuit 503. In this exemplary embodiment, output stage 500 is configured with a current feedback amplifier 504, a pass device 506, and a divider network 508, such as disclosed more fully in U.S. patent application Ser. No. 10/151,366, entitled "Low Drop-Out Regulator Having Composite Amplifier With Current Feedback Buffer", filed on May 20, 2002, and having a common inventor and common assignee as the present application, and hereby incorporated herein by reference. However, it should be noted that the discussion of output stage 500 is merely for illustrative purposes, and output stage compensation circuit 503 can be suitably configured at the output of various error amplifier or buffer configurations within an output stage of a low drop-out regulator, or within any other output stage configuration.

In accordance with this exemplary embodiment, current feedback amplifier 504 suitably comprises pairs of input devices, including transistor device 518 and diode-connected device 522, and transistor device 520 and diode-connected device 524, a pair of current mirrors 526 and 528, and a pair of upper rail transistors 550 and 552. Input transistor devices 518 and 520 are configured for receiving input current signals at their source terminals, such as from voltage terminals $V_{pp}(+)$ and $V_{nn}(-)$, respectively, with the source of input transistor device 518 comprising the positive, non-inverting input terminal and the source of input transistor device 520 comprising the negative, inverting input terminal of current feedback amplifier 504. Input device 518 has a gate coupled to a gate of a diode-connected transistor device 522, while input device 520 has a gate coupled to a gate of a diode-connected transistor device 524. In addition, input device 518 has a drain coupled to current mirror 526, while input device 520 has a drain coupled to current mirror 528.

Diode-connected devices 522 and 524 are configured to facilitate control of the flow of quiescent current through input devices 518 and 520. Diode-connected devices 522 and 524 are configured to control the gates of input devices 518 and 520 in a fixed manner such that any current flowing input current signals, such as from voltage terminals $V_{pp}(+)$ and $V_{nn}(-)$, will be directed through input devices 518 and 520, respectively. Diode-connected device 522 has a drain coupled to ground through a current source 514, while diode-connected device 524 has a drain coupled to ground through a current source 516, with current sources 514 and 516 being configured to provide a low quiescent current flowing through diode-connected devices 522 and 524, and thus to hold input devices 518 and 520 at a low quiescent current, i.e., under DC conditions. Current sources 514 and 516 can be suitably driven by a current source device 510, which can comprise various current source configurations, through a diode-connected device 512 configured to mirror current from current source device 510 to the gates of current sources 514 and 516.

Current mirrors 526 and 528 are configured to mirror the current flowing through transistors 518 and 520, and provide the mirrored current to transistors 550 and 552 coupled to the upper rail of current feedback buffer 504. Current mirror 528 includes a lower rail output device 529 configured for driving an output signal to an output terminal $V_{GATE}$ of current feedback amplifier 504. Upper rail transistors 550 and 552 are configured for driving an output current at output terminal $V_{GATE}$. Transistor 550 is configured to mirror any current received from current mirror 526 and provide the mirrored current to output terminal $V_{GATE}$ from the drain of output transistor 552, which comprises the output device for current feedback amplifier 504.

Pass device 506 comprises a power transistor device configured for driving an output current $I_{OUT}$ to a load device. In the exemplary embodiment, pass device 506 comprises a PMOS transistor device having a source coupled to a supply voltage rail $V_{IN}$, a drain coupled to an output voltage terminal $V_{OUT}$, and a gate coupled to output terminal $V_{GATE}$ of current feedback buffer 504. However, pass device 506 can comprise any power transistor configuration for driving output current $I_{OUT}$ to a load device. In addition, pass device 506 is configured to source as much current as needed by the load device and/or divider network 508.

Divider network 508 suitably comprises a resistive divider configured for providing a feedback signal. In the exemplary embodiment, divider network 508 comprises a pair of resistors $R_{D1}$ and $R_{D2}$. However, divider network 508 can comprise any configuration of resistors for providing a voltage divider operation. Resistor $R_{D1}$ is coupled between pass device 506 and resistor $R_{D2}$, while resistor $R_{D2}$ is connected to ground or a lower rail. As discussed more fully in U.S. patent application Ser. No. 10/151,366, a feedback signal can be provided from a node $V_{FDBK}$ configured between resistors $R_{D1}$ and $R_{D2}$, to the negative input terminal of an error amplifier of the input stage of a low drop-out regulator.

Output stage compensation circuit 503 suitably comprises a plurality of segmented sense devices 530, 532, 534, 536 and 538 configured to drive a plurality of fixed current sources 540, 542, 544, 546 and 548, respectively. Each segmented sense device 530, 532, 534, 536 and 538 is configured to compensate a suitable range of output current and suitably comprises a sense transistor having a source coupled to upper supply rail voltage $V_{IN}$, a gate coupled to output terminal $V_{GATE}$ of current feedback amplifier 504, e.g., the drain of output transistor 552, and a drain coupled to current sources 540, 542, 544, 546 and 548, respectively. In that all of the gates of segmented sense devices 530, 532, 534, 536 and 538 are commonly tied to a node $V_{GATE}$, i.e., at the drain of output transistor 552, each of segmented sense devices 530, 532, 534, 536 and 538 are configured to be driven by, and thus sense, the same output current signal.

In addition, each of segmented sense devices 530, 532, 534, 536 and 538 include a compensation capacitor, such as capacitors $C_1$, $C_2$, $C_3$, $C_4$ and $C_5$, respectively, coupled to their gate and drain terminals. Compensation capacitors $C_1$, $C_2$, $C_3$, $C_4$ and $C_5$ are suitably configured to provide the pole-zero compensation from output stage compensation circuit 503. Segmented sense devices 530, 532, 534, 536 and 538 are configured to suitably adjust the pole-zero compensation by multiplying the effect of compensation capacitors $C_1$, $C_2$, $C_3$, $C_4$ and $C_5$. Further, although not illustrated in FIG. 5, segmented sense devices 530, 532, 534, 536 and 538 can include resistors, for example parasitic, passive, active or other types of resistors, configured in series with compensation capacitors $C_1$, $C_2$, $C_3$, $C_4$ and $C_5$ to further adjust the pole-zero compensation.

The compensation for the various ranges of output current can be overlapped by the plurality of segmented sense devices 530, 532, 534, 536 and 538. Further, segmented sense devices 530, 532, 534, 536 and 538 are configured as scale devices to suitably cover the various ranges of current. For example, the scaling of segmented sense devices 530, 532, 534, 536 and 538 can be configured over various ranges, such as octave, decade or other scaling ranges.

In accordance with an exemplary embodiment, the scaling of segmented sense devices 530, 532, 534, 536 and 538 can be configured in an octave scaling arrangement, i.e., binary scaled devices, with the size of sense device 530 configured as a 16X device, sense device 532 configured as a 8X device, sense device 534 configured as a 4X device, sense device 536 configured as a 2X device, and sense device 538 configured as a 1X device. The largest device, i.e., sense device 530 with a 16X size, is configured to operate when the output current of current feedback amplifier 504 is extremely low. On the other hand, the smallest device, i.e., sense device 538 with a 1X size, is configured to operate when the output of current feedback amplifier 504 is at approximately a full current.

Current sources 540, 542, 544, 546 and 548 are suitably configured to supply current to each of segmented sense devices 530, 532, 534, 536 and 538, respectively. Current sources can be configured as fixed current sources under DC conditions, and as fixed or active current sources under transient conditions. Current sources 540, 542, 544, 546 and 548 comprise NMOS devices configured with drains coupled to the drains of segmented sense devices 530, 532, 534, 536 and 538, respectively, sources coupled to ground, and gates driven by current mirror 528, i.e., current supplied from the drain of input device 520.

Current sources 540, 542, 544, 546 and 548 can also be suitably scaled to supply various amounts of current, i.e., scaled over various ranges, such as octave, decade or other scaling ranges. In accordance with the exemplary embodiment, current sources 540, 542, 544, 546 and 548 are suitably scaled in a manner inversely proportional to the scaling of segmented sense devices 530, 532, 534, 536 and 538. For example, current sources 540, 542, 544, 546 and 548 can be suitably scaled in an octave scaling arrangement, i.e., binary scaled current sources, with the size of current source 540 configured as a 1X device, current source 542 configured as a 2X device, current source 544 configured as a 4X device, current source 546 configured as a 8X device, and current source 548 configured as a 16X device. Accordingly, the largest sense device, segmented sense device 530 is configured with the smallest current source, i.e., current source 540. This results in very low ground current when the output current is low. On the other hand, the smallest sense device, i.e., sense device 538 with a 1X size, is configured to operate with the largest current source, i.e., current source 548, resulting in the largest ground current when the output current is the highest. Further, although not illustrated in FIG. 5, current sources 540, 542, 544, 546 and 548 can include resistors, for example parasitic, passive, active or other types of resistors, configured in series with their respective drains to further adjust the pole-zero compensation.

In accordance with another aspect of the present invention, the output stage compensation scheme significantly reduces die area required for compensation. For example, while large compensation capacitors $C_1$, $C_2$, $C_3$, $C_4$ and $C_5$ can provide additional compensation effects, larger capacitors require significantly increased die area. However, the gain from the gates of segmented sense devices 530, 532, 534, 536 and 538 to corresponding active nodes A, B, C, D and E effectively multiplies corresponding compensation capacitors $C_1$, $C_2$, $C_3$, $C_4$ and $C_5$ by the gain realized on any active node A, B, C, D and E in the active region.

While output stage compensation circuit 503 comprises five segmented sense devices 530, 532, 534, 536 and 538, any number of segmented sense devices and corresponding current sources can be suitably included within various other embodiments. For example, an exemplary output stage compensation circuit can comprise eight, ten, or sixteen segmented sense devices or any other number in between, or greater than, these numbers of devices. Thus, although not explicitly shown, such other configurations of segmented sense devices and current sources are included within the scope of the present invention. For example, the segmented sense devices can comprise PNP devices, while the current sources can comprise NPN devices.

To further illustrate the benefits of output stage compensation circuit 503, operation of output stage 500 can be provided. Initially, with no output load at output terminal $V_{OUT}$, and with output device 552 of current feedback amplifier 504 being turned on fully, no current will flow from output terminal $V_{GATE}$ to the gate of pass device 506. As a result, each of active nodes A, B, C, D and E, corresponding to the drains of segmented sense devices 530, 532, 534, 536 and 538, respectively, will be pulled to the lower rail, e.g., to ground, by current sources 540, 542, 544, 546 and 548. However, as the output load undergoes a transition, an output current will begin to flow from output terminal $V_{GATE}$ of current feedback amplifier 504. As the output current begins to flow, segmented sense device 530, being the largest device, will begin to turn on to sense the output current, and will draw current from current source 540, which will pull up node A towards upper rail supply $V_{IN}$.

As the output current from output terminal $V_{GATE}$ of current feedback amplifier 504 continues to increase, segmented sense device 532, being the second largest device, will begin to turn on to also sense the output current, and will draw current from current source 542, which will pull up node B towards upper rail supply $V_{IN}$. Likewise, as the output current from current feedback amplifier 504 continues to increase, segmented sense devices 534, 536 and 538, being the next consecutively-decreasing sized devices, will begin to suitably turn on to also sense the output current, and will draw current from current sources 544, 546 and 548, respectively, which will pull up nodes C, D and E towards upper rail supply $V_{IN}$.

Each active node A, B, C, D and E will continue to be pulled up approximate to the upper rail supply $V_{IN}$, until the corresponding sense device 530, 532, 534, 536 or 538 cannot draw any additional current. For example, as the output load increases, segmented sense device 530 will sense the output current, and will draw current from current source 540 to pull up node A to upper rail supply $V_{IN}$. Once node A is pulled up to approximately upper rail supply $V_{IN}$, segmented sense device 530 will cease to draw further current from current source 540, i.e., sense device 530, in essence is fully turned on, and thus ceases to further compensate the output current of low drop-out regulator 500. However, further compensation can be provided by segmented sense devices 532, 534, 536 and 538 until each of sense devices 532, 534, 536 or 538 are fully turned on. Thus, for an exemplary embodiment having 1 mA of output current flowing from output terminal $V_{GATE}$ of current feedback amplifier 504, nodes A, B, C and D may be pulled upwards to approximately upper rail supply $V_{IN}$, i.e., sense devices 530, 532, 534 and 536 are fully turned on, with compensation being provided by sense device 538.

While the current drawn by segmented sense devices 530, 532, 534, 536 and 538 from current sources 540, 542, 544, 546 and 548 eventually comprises wasted ground current, as opposed to output load current at output terminal $V_{OUT}$, the amount of such ground current is limited by current sources 540, 542, 544, 546 and 548, and is only utilized when compensation is provided to the output current. As a result, this loss of ground current is well justified in the effective compensation of low drop-out regulator 500. In any event, output stage compensation circuit 503 results in a very high effective beta β, which is the ratio of the output load current at output terminal $V_{OUT}$ to the wasted ground current, and is an important measure of the efficiency of low drop-out regulator 500.

In addition, during transient conditions when the current from output terminal $V_{GATE}$ of current feedback amplifier 504 is increasing or decreasing, segmented devices 530, 532, 534, 536 and 538 and current sources 540, 542, 544, 546 and 548, which are configured as active current sources, operate to increase the effective range of compensation over a range of output current. For example, when the current from output terminal $V_{GATE}$ increases to suitably drive the gate of sense devices 530, 532, 534, 536 and 538, nodes A, B, C, D and E are suitably pulled upwards to upper rail supply $V_{IN}$. However, the current flowing from current mirror 528 to drive the gates of current sources 540, 542, 544, 546 and 548 also suitably increases, current sources 540, 542, 544, 546 and 548 are active devices that attempt to pull nodes A, B, C, D and E downwards to ground. This "tug-of-war" operation between sense devices 530, 532, 534, 536 and 538 and current sources 540, 542, 544, 546 and 548 increases the range of currents that nodes A, B, C, D and E can operate, and thus increases the effective range of compensation.

The present invention has been described above with reference to various exemplary embodiments. However, those skilled in the art will recognize that changes and modifications may be made to the exemplary embodiments without departing from the scope of the present invention. For example, the various components may be implemented in alternate ways, such as, for example, by implementing BJT devices for various of the transistor devices. Further, the various exemplary embodiments can be implemented with other types of circuits in addition to those illustrated above. These alternatives can be suitably selected depending upon the particular application or in consideration of any number of factors associated with the operation of the system. Moreover, these and other changes or modifications are intended to be included within the scope of the present invention, as expressed in the following claims.

What is claimed is:

1. A low drop-out regulator having a compensation scheme for providing stable operation while providing output current to a downstream circuit device, said low drop-out regulator comprising:

a pass device comprising a power transistor for driving a load current to the downstream device, said pass device having a control terminal;

an error amplifier for providing an output current configured for driving said control terminal of said pass device; and an output stage compensation circuit comprising at least one segmented sense device configured to sense said output current.

2. The low drop-out regulator according to claim 1, wherein said output stage compensation circuit further comprises at least one current source corresponding to said at least one segmented sense device, said at least one current source being configured to supply current to said at least one segmented sense device.

3. The low drop-out regulator according to claim 2, wherein said output stage compensation circuit comprises a plurality of segmented sense devices and a plurality of current sources, said plurality of current sources corresponding to said plurality of segmented sense devices and being configured to supply current to said plurality of segmented sense devices.

4. The low drop-out regulator according to claim 3, wherein each of said plurality of segmented sense devices comprises a sense transistor having a source coupled to an upper supply rail, a gate coupled to gate of pass device, and a drain coupled to one of said plurality of current sources.

5. The low drop-out regulator according to claim 3, wherein said at least one segmented sense device comprises a compensation capacitor coupled between a control terminal and an output terminal of said at least one segmented sense device.

6. The low drop-out regulator according to claim 3, wherein plurality of current sources comprise active current sources to increase an effective range of compensation for a range of said output current.

7. The low drop-out regulator according to claim 3, wherein said plurality of segmented sense devices and said plurality of current sources are scaled to compensate various ranges of output current.

8. The low drop-out regulator according to claim 7, wherein said segmented sense devices are increasingly scaled in one of an octave and a decade scale.

9. The low drop-out regulator according to claim 7, wherein said plurality of current sources are scaled in a manner inversely proportional to said segmented sense devices.

10. The low drop-out regulator according to claim 1, wherein said low drop-out regulator further comprises a current feedback amplifier coupled to an output terminal of said error amplifier and configured to provide said output current for driving said control terminal of said pass device.

11. A compensation circuit for compensation of an output stage, said compensation circuit comprising:

at least one segmented sense device configured to provide pole-zero compensation, said at least one segmented sense device comprising a sense transistor having a control terminal configured for coupling to a control terminal of a pass device; and at least one current source configured for supplying current to said at least one segmented sense device.

12. The output stage compensation circuit according to claim 11, wherein said at least one segmented sense device further comprises an input terminal configured for coupling to an upper supply rail and an output terminal coupled to said at least one current source.

13. The output stage compensation circuit according to claim 12, wherein said at least one segmented sense device further comprises a compensation capacitor coupled between said control terminal and said output terminal of said at least one segmented sense device.

14. The output stage compensation circuit according to claim 13, wherein said output stage compensation circuit further comprises a plurality of segmented sense devices having a plurality of compensation capacitors and a plurality of current sources comprising active current sources.

15. The output stage compensation circuit according to claim 14, wherein said plurality of segmented sense devices are scaled to provide facilitate compensation for overlapping ranges of output current.

16. The output stage compensation circuit according to claim 15, wherein said plurality of current sources are scaled inversely proportional in size to said plurality of segmented sense devices.

17. The output stage compensation circuit according to claim 14, wherein said plurality of segmented sense devices are configured to multiply the effects of compensation from said compensation capacitors.

18. The output stage compensation circuit according to claim 11, wherein a control terminal of said at least one current source can be actively driven by a current-mirror device of a current feedback amplifier.

19. The output stage compensation circuit according to claim 14, wherein said plurality of segmented sense devices comprise a large scaled sense device configured to provide compensation at extremely low levels of output current.

20. The output stage compensation circuit according to claim 19, wherein said plurality of segmented sense devices comprise a small scaled sense device configured with said large scaled sense device to effectively limit ground current utilized during compensation at low output currents.

21. The output stage compensation circuit according to claim 13, wherein said compensation capacitor is configured in series with a resistor, and said at least one current source is configured in series with another resistor, both of said resistor and said another resistor being configured for adjusting pole-zero compensation.

22. A method for compensation of an output stage, said method comprising the steps of:

sensing an output current provided to a control terminal of a pass device with a first segmented sense device having a first compensation capacitor; and compensating the output stage through said first compensation capacitor.

23. The method according to claim 22, wherein said method further comprises the steps of:

sensing said output current provided to said control terminal of said pass device with a second segmented sense device having a second compensation capacitor, said second segmented sense device being configured to sense said output current at an increased current level, said second segmented sense device comprising a smaller transistor device than said first segmented sense device; and compensating said output stage through said first compensation capacitor and said second compensation capacitor.

24. The compensation method according to claim 23, wherein said step of sensing with said first segmented sense device comprises drawing current from a first current source.

25. The compensation method according to claim 24, wherein said step of sensing with said second segmented sense device comprises drawing current from a second current source larger than said first current source.

26. The compensation method according to claim 23, wherein said method further comprises the steps of sensing said output current with a plurality of additional segmented sense devices having a plurality of compensation capacitors, with each of said plurality of additional segmented sense devices being scaled in size, configured to sense multiple levels of output current, and being coupled to a one of a plurality of additional current sources.

27. The compensation method according to claim 26, wherein said plurality of additional current sources is scaled in a manner inversely proportional to said plurality of additional segmented sense devices.

28. The compensation method according to claim 26, wherein said plurality of additional segmented sense devices is configured to multiply compensation effects of said plurality of compensation capacitors.

* * * * *